US007605331B2

(12) United States Patent
Cho

(10) Patent No.: US 7,605,331 B2
(45) Date of Patent: Oct. 20, 2009

(54) RATCHET-HEAD CONDUCTOR LOCKING MEDIUM VOLTAGE ELECTRICAL BUS POLYMER INSULATOR WITH PIN MOUNT

(75) Inventor: May K. Cho, Sudbury, MA (US)

(73) Assignee: Bendrix Wire & Cable, Inc., Milford, NH (US)

( * ) Notice: Subject to any disclaimer, the term of this patent is extended or adjusted under 35 U.S.C. 154(b) by 0 days.

(21) Appl. No.: 12/035,883

(22) Filed: Feb. 22, 2008

(65) Prior Publication Data

US 2008/0202794 A1 Aug. 28, 2008

Related U.S. Application Data

(60) Provisional application No. 60/891,150, filed on Feb. 22, 2007.

(51) Int. Cl.
*H01B 17/00* (2006.01)

(52) U.S. Cl. ..... 174/169; 174/168; 174/156; 174/138 F; 174/178; 174/174; 254/134; 24/525

(58) Field of Classification Search ..... 174/168, 174/156, 138 F, 163 F, 165, 169, 171, 174, 174/178; 254/134.3 R; 24/525; 248/74.4
See application file for complete search history.

(56) References Cited

U.S. PATENT DOCUMENTS

| | | | | |
|---|---|---|---|---|
| 574,828 | A * | 1/1897 | Smook | 174/168 |
| 3,483,314 | A * | 12/1969 | Harmon | 174/140 R |
| 4,134,574 | A | 1/1979 | Jean et al. | |
| 4,178,470 | A | 12/1979 | Jean et al. | |
| 4,258,228 | A | 3/1981 | Jean et al. | |

* cited by examiner

*Primary Examiner*—Dhiru R Patel
(74) *Attorney, Agent, or Firm*—DLA Piper LLP US; Jennifer E. Lacroix, Esq.

(57) ABSTRACT

Cable support insulators of the present invention generally have an insulator body having a cable base and a plurality of insulator sheds. The cable base has a ratchet locking mechanism to secure an electrical conductor to the insulator. In preferred embodiments, a cable support insulator is provided that has an insulator body includes a plurality of insulator sheds and a cable base. A locking base is connected to the cable base, and a retaining clamp is pivotally connected to the cable base. The cable base has a front end, a back end, and a seat adapted to receive a conductor cable. The locking base has a front plate having a plurality of ratchet teeth. The retaining clamp has a first retaining arm, a second retaining arm, and a locking blade.

19 Claims, 3 Drawing Sheets

RATCHET-HEAD CONDUCTOR LOCKING MEDIUM VOLTAGE ELECTRICAL BUS POLYMER INSULATOR WITH PIN MOUNT

RELATED APPLICATIONS

This application claims the benefit of U.S. Provisional Patent Application Ser. No. 60/891,150, filed Feb. 22, 2007, currently pending, the disclosure of which is hereby incorporated by reference in its entirety.

BACKGROUND

The present invention generally relates to a bus insulator and clamping system. More particularly, the present invention relates to a bus insulator and clamping system featuring a ratchet locking mechanism to secure an electrical conductor to hanger mount.

Electric utilities have previously used many materials for the construction of bus support insulators used in medium voltage cable supports. These bus insulators are generally in two parts, the insulator and the clamp to secure the cable to the insulator. Further the cable clamp may be of many sizes to accommodate various cable insulation diameters.

BRIEF SUMMARY

Cable support insulators of the present invention generally have an insulator body having a cable base and a plurality of insulator sheds. The cable base has a ratchet locking mechanism to secure an electrical conductor to the insulator.

In one aspect, a cable support insulator is provided that has an insulator body comprising a plurality of insulator sheds and a cable base, a locking base connected to the cable base, and a retaining clamp pivotally connected to the cable base. The cable base has a front end, a back end, and a seat adapted to receive a conductor cable. The locking base has a front plate having a plurality of ratchet teeth. The retaining clamp has a first retaining arm, a second retaining arm, and a locking blade.

In a second aspect, a cable support insulator is provided that has insulator body comprising a plurality of insulator sheds and a cable base, where the cable base has a front end, a back end having a socket member, and a seat adapted to receive a conductor cable. The cable support insulator also has a locking base connected to front end of the cable base, and a retaining clamp pivotally connected to the socket member. The locking base has a front plate having a plurality of ratchet teeth. The retaining clamp has a first retaining arm, a second retaining arm, and a locking blade that extends transversely from the first retaining arm to the second retaining arm. The retaining clamp has an open position and a cable engaging position, and the locking blade engages at least one of the plurality of ratchet teeth when the retaining clamp is in the cable engaging position.

In a third aspect, a cable support insulator has an insulator body having a top end and a bottom end, where the insulator body has a cable base at the top end of the insulator body and a plurality of insulator sheds spaced on the insulator body below the cable base. The cable base has a front end, a back end having a socket member, and a seat adapted to receive a conductor cable. The cable support insulator also has a locking base connected to the cable base, and a retaining clamp pivotally connected to the cable base. The locking base has a front plate having a plurality of ratchet teeth. The retaining clamp is pivotally connected to the cable base, and has an open position and a cable engaging position. The retaining clamp has a first retaining arm having a guide that engages the front plate of the locking base when the retaining clamp is in the cable retaining position, a second retaining arm that engages the front plate of the locking base when the retaining clamp is in the cable retaining position, and a locking blade that engages at least one of the plurality of ratchet teeth when the retaining clamp is in the cable engaging position.

DETAILED DESCRIPTION

Cable support insulators of the present invention generally have a ratchet locking mechanism to secure an electrical conductor cable to the insulator. Preferably, the electrical conductor cables are medium voltage electrical conductors, having a voltage of from about 5 kv to about 35 kv.

Figure 1:
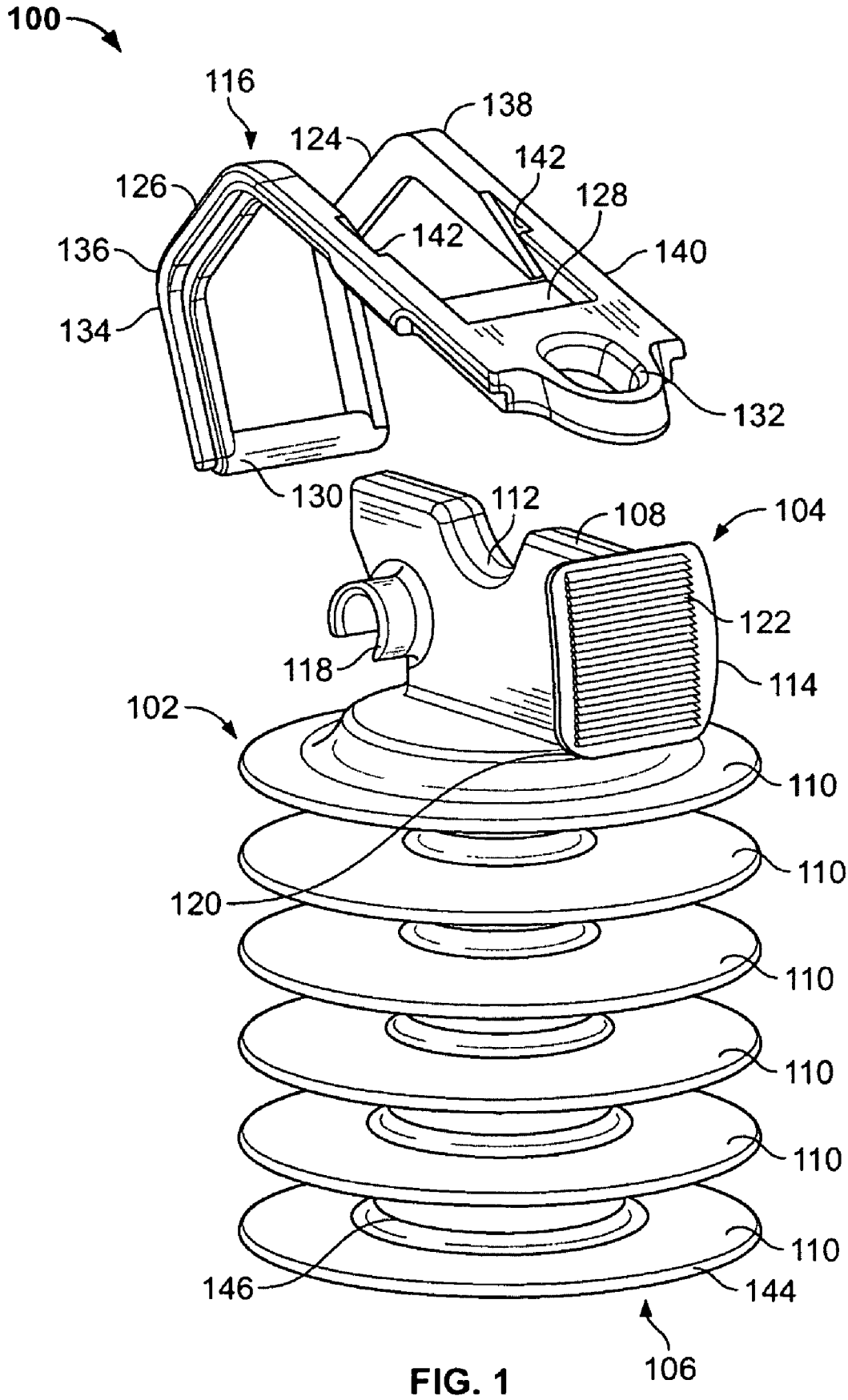
FIG. 1 is an exploded front perspective view of one embodiment of a cable support insulator.
Figure 2:
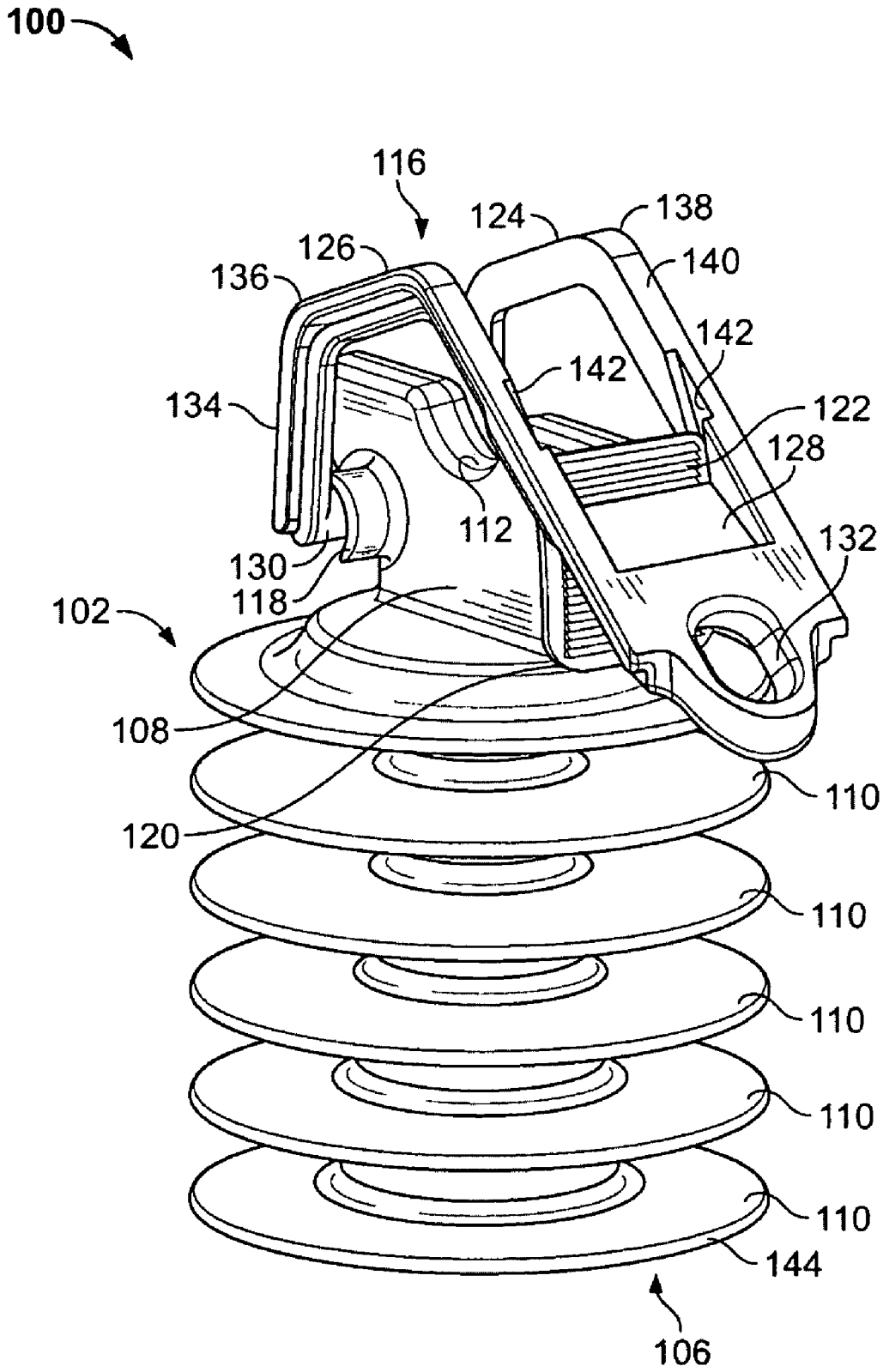
FIG. 2 is a front perspective view of the embodiment of FIG. 1, in as assembled in a cable engaging position.
Figure 3:
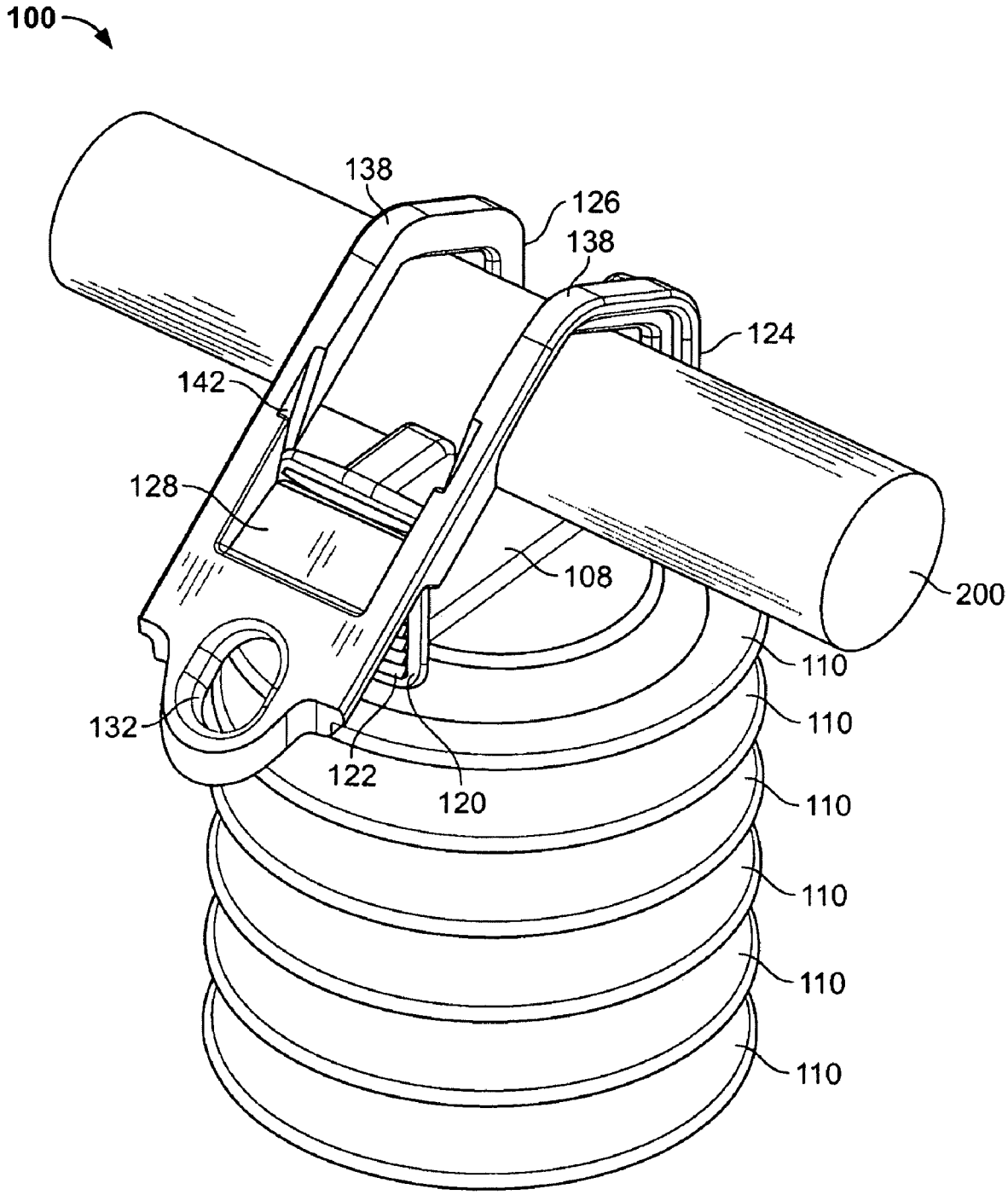
FIG. 3 is a front perspective view of the embodiment of FIGS. 1 and 2, as assembled in a cable engaging position, and having a cable engaged therein.

A preferred embodiment of a cable support insulator 100 is illustrated in FIGS. 1-3. Cable support insulator 100 has an insulator body 102 having a top end 104 and a bottom end 106. Cable base 108 is located at the top end of the insulator body 102, and there are a plurality of insulator sheds 110 that are spaced on the insulator body 102 below the cable base. At the bottom end of the insulator body 102, there is preferably a pin mount.

The cable base 108 has a front end, a back end, and a seat 112 adapted to receive a conductor cable. A locking base 114 is connected to the front end of the cable base 108. A retaining clamp 116 pivotally connected to the back end of the cable base 108. Preferably, the seat 112 is an arcuate groove in the cable base, which can receive a conductor cable placed transversely across the seat. Accordingly, the arcuate groove of seat 112 is preferably concave up, and extends along at least a portion of the length of the cable base 108. More preferably, the seat 112 is located at or near the center of the upper surface of the cable base 108. The cable base 108 preferably has at least one socket 118 on its back end, which pivotally receives the retaining clamp 116.

Locking base 114 is connected to the front end of the cable base 108. Locking base 114 has a front plate 120. Preferably, locking base 114 is fixedly connected to the front end of the cable base 108. Front plate 120 is preferably arcuate, and forms a curve that bows outwardly from the cable base 108. Front plate 120 has at least one locking feature on its face. Preferably, the locking feature is a plurality of ratchet teeth 122. The plurality of ratchet teeth 122 preferably extends down a substantial portion of the length of the front plate 120. Additionally, each of the ratchet teeth 122 preferably extends transversely across a substantial portion of the width of front plate 120. As illustrated if FIGS. 1 through 3, the ratchet teeth 122 do not extend transversely along the entire width of the front plate 120, such that there is a border area around ratchet teeth 122. Ratchet teeth 122 allow for an adjustable locking engagement between the retaining clamp 116 and the locking base 114, allowing the cable support insulator 100 to be utilized with cables of various diameters.

Retaining clamp 116 is pivotally connected to the back end of the cable base 108, and is rotatable about that pivotal connection from an open position to a cable engaging position. The retaining clamp 116 has a first retaining arm 124, a second retaining arm 126, and a locking blade 128. Locking blade 128 extends transversely from, the first retaining arm 124 to the second retaining arm 126, and is connected to both retaining arms. Locking blade 128 is preferably integrally formed with the first and second retaining arms. Locking blade 128 can be arcuate, and preferably has a curve that compliments the curve of the front plate 120. Locking blade 128 of the retaining clamp 116 engages at least one of the ratchet teeth of the locking base when the retaining clamp 116 is in the cable retaining position. Retaining clamp 116 preferably also has a mounting member 130 that is received by, and forms a pivotal connection with, the socket 118 on the back of the cable base 108. Mounting member 130 can have any suitable configuration, but is preferably a cylindrical bar that extends transversely from the first retaining arm 124 to the second retaining arm 126. Retaining clamp 116 can also include a gripping aperture 132 connected to the first and second retaining arms. Gripping aperture 132 can be used to grip the retaining clamp 116 in order to rotate it from its open position to its cable engaging position. For example, in a preferred embodiment, gripping aperture 132 can be gripped by a hot stick, which can then be used to rotate the retaining clamp downwards from its open position to its cable engaging position.

The retaining clamp 116 is generally arcuate, extending up from the pivotal connection at the back end of the cable base 108, curving over the cable base 108, and then extending downwards such that the locking blade 128 can engage the ratchet teeth 122 on the front plate 120 of the locking base 114. As illustrated in FIG. 3, the retaining clamp 116 is adapted to engage the surface of a conductor cable 200 positioned in the seat 112 of the cable base 108.

Each retaining arm comprises a first section 134, a fulcrum section 136 adjacent to the first section 134, a contact section 138 adjacent to the fulcrum section 136, and a second section 140 adjacent to the contact section 138. The fulcrum section 136 comprises a first angle, and the contact section 138 comprises a second angle. The first and second angles can be equal or different. Contact section 138 is preferably configured to center the cable in the seat 112 as the locking blade 128 is moved downward on the ratchet teeth 122 to achieve the cable locking position of the retaining clamp 116. Centering of the cable facilitates the accommodation of cables having various diameters. Preferably, each retaining arm also comprises a guide 142 that engages the front plate of the locking base when the retaining clamp is in the cable retaining position. Each guide 142 is preferably an abutment or groove that engages the front plate 120 to facilitate the maintenance of the locking engagement between the locking blade 128 and the ratchet teeth 122.

Insulator sheds 110 are located on the insulator body 102 below the cable base 108. Preferably, there are a plurality of insulator sheds, which are spaced along the insulator body 102. Preferably, the insulator sheds are generally tiered, and are vertically stacked. Each insulator shed preferably has a flange member 144 and a spacer member 146. The spacer members each preferably have a diameter, and the diameter of the spacer members preferably decreases from the bottom end of the insulator body 102 towards the top end of the insulator body 102.

Cable support insulators of the present invention are preferably made from suitable electrically insulating polymers. Examples of suitable electrically insulating polymers include, but are not limited to, thermoplastic materials. Particularly preferred materials include, for example, high density polyethylene (HDPE), epoxies (Cycloaliphatics), and polyurethane. Cable support insulators made from such materials tend to be electrically track resistant and non-breakable. They also tend to be lighter in weight and lower in cost than insulators made from conventional materials. When cable support insulators are made from suitable electrically insulating polymers, any appropriate method of manufacturing the component parts can be utilized, including, for example, injection molding and/or casting.

From the foregoing, it will be appreciated that although specific embodiments of the invention have been described herein for purposes of illustration, various modifications may be made without deviating from the spirit or scope of the invention. It is therefore intended that the foregoing detailed description be regarded as illustrative rather than limiting, and that it be understood that it is the following claims, including all equivalents, that are intended to particularly point out and distinctly claim the subject matter regarded as the invention.

What is claimed is:

1. A cable support insulator comprising:

an insulator body, the insulator body comprising a plurality of insulator sheds and a cable base, the cable base having a front end, a back end, and a seat adapted to receive a conductor cable;

a locking base connected to the cable base, the locking base comprising a front plate having a plurality of ratchet teeth; and a retaining clamp pivotally connected to the cable base, the retaining clamp comprising a first retaining arm, a second retaining arm, and a locking blade;

wherein the locking blade of the retaining clamp engages at least one of the ratchet teeth of the locking base when the retaining clamp is in a cable retaining position.

2. The cable support insulator of claim 1, wherein the front plate of the locking base is arcuate.

3. The cable support insulator of claim 1, wherein the seat is an arcuate groove in the cable base, the arcuate groove being concave up.

4. The cable support insulator of claim 1, wherein each retaining arm comprises a first section, a fulcrum section adjacent to the first section, a contact section adjacent to the fulcrum section, and a second section adjacent to the contact section.

5. The cable support insulator of claim 4, wherein the fulcrum section comprises a first angle, and the contact section comprises a second angle.

6. The cable support insulator of claim 1, wherein the retaining clamp has an open position and the cable retaining position.

7. The cable support insulator of claim 6, wherein each retaining arm comprises a guide that engages the front plate of the locking base when the retaining clamp is in the cable retaining position.

8. The cable support insulator of claim 1, wherein the insulator body and the retaining clamp both comprise a thermoplastic material.

9. The cable support insulator of claim 1, wherein the insulator body and the retaining clamp each comprise a high density polyethylene, an epoxy, or a polyurethane.

10. The cable support insulator of claim 1, further comprising a gripping aperture connected to the first and second retaining arms.

11. The cable support insulator of claim 1, wherein the cable base is at the top of the insulator body, and the insulator sheds are spaced on the insulator body below the cable base.

12. A cable support insulator comprising:

an insulator body, the insulator body comprising a plurality of insulator sheds and a cable base, the cable base having a front end, a back end having a socket member, and a seat adapted to receive a conductor cable;

a locking base connected to the front end of the cable base, the locking base comprising a front plate having a plurality of ratchet teeth; and a retaining clamp pivotally connected to the socket member that has an open position and a cable engaging position, the retaining clamp comprising a first retaining arm, a second retaining arm, and a locking blade that extends transversely from the first retaining arm to the second retaining arm;

wherein the locking blade engages at least one of the plurality of ratchet teeth when the retaining clamp is in the cable engaging position.

13. The cable support insulator of claim 12, wherein the front plate of the locking base is arcuate.

14. The cable support insulator of claim 12, wherein the seat is an arcuate groove in the cable base, the arcuate groove being concave up.

15. The cable support insulator of claim 12, wherein each retaining arm comprises a first section, a fulcrum section adjacent to the first section, a contact section adjacent to the fulcrum section, and a second section adjacent to the contact section.

16. The cable support insulator of claim 12, wherein each retaining arm comprises a guide that engages the front plate of the locking base when the retaining clamp is in the cable engaging position.

17. The cable support insulator of claim 12, wherein the body and the retaining clamp each comprise a high density polyethylene, an epoxy, or a polyurethane.

18. The cable support insulator of claim 12, wherein the cable base is at the top of the insulator body, and the insulator sheds are spaced on the insulator body below the cable base.

19. A cable support insulator comprising:

an insulator body having a top end and a bottom end, the insulator body comprising a cable base at the top end of the insulator body and a plurality of insulator sheds spaced on the insulator body below the cable base, the cable base having a front end, a back end having a socket member, and a seat adapted to receive a conductor cable;

a locking base connected to the cable base, the locking base comprising a front plate having a plurality of ratchet teeth; and a retaining clamp pivotally connected to the cable base that has an open position and a cable engaging position, the retaining clamp comprising a first retaining arm having a guide that engages the front plate of the locking base when the retaining clamp is in the cable retaining position, a second retaining arm that engages the front plate of the locking base when the retaining clamp is in the cable retaining position, and a locking blade that engages at least one of the plurality of ratchet teeth when the retaining clamp is in the cable engaging position.

* * * * *

UNITED STATES PATENT AND TRADEMARK OFFICE

CERTIFICATE OF CORRECTION

PATENT NO. : 7,605,331 B2
APPLICATION NO. : 12/035883
DATED : October 20, 2009
INVENTOR(S) : May K. Cho It is certified that error appears in the above-identified patent and that said Letters Patent is hereby corrected as shown below:

Title Page

Please correct the Assignee as follows:

(73) Assignee: Bendrix Wire & Cable, Inc., Milford, NH (US) to --Hendrix Wire & Cable, Inc., Milford, NH (US)--

Signed and Sealed this

First Day of December, 2009

David J. Kappos

David J. Kappos
*Director of the United States Patent and Trademark Office*